US008878457B2

(12) United States Patent
Schenk et al.

(10) Patent No.: US 8,878,457 B2
(45) Date of Patent: Nov. 4, 2014

(54) ADAPTABLE LIGHTING SYSTEM

(75) Inventors: Tim Corneel Wilhelmus Schenk, Eindhoven (NL); Marcel Beij, Sint Oedenrode (NL); George Frederic Frederic Yianni, Eindhoven (NL); Gerardus Henricus Adrianus Johannes Broeksteeg, Veldhoven (NL); Lucius Theodorus Vinkenvleugel, Veldhoven (NL); Lorenzo Feri, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 168 days.

(21) Appl. No.: 13/519,410

(22) PCT Filed: Dec. 30, 2010

(86) PCT No.: PCT/IB2010/056142

§ 371 (c)(1), (2), (4) Date: Jun. 27, 2012

(87) PCT Pub. No.: WO2011/083394

PCT Pub. Date: Jul. 14, 2011

(65) Prior Publication Data

US 2012/0299510 A1 Nov. 29, 2012

(30) Foreign Application Priority Data

Jan. 6, 2010 (EP) ..... 10150162

(51) Int. Cl.
*H05B 37/02* (2006.01)

(52) U.S. Cl.
CPC ..... *H05B 37/029* (2013.01)
USPC ..... 315/294; 315/307; 315/312

(58) Field of Classification Search
USPC ..... 315/149–158, 291, 297, 307, 312
See application file for complete search history.

(56) References Cited

U.S. PATENT DOCUMENTS 6,300,724 B1 * 10/2001 Luz et al. ..... 315/250
7,852,016 B2 * 12/2010 Kang et al. ..... 315/291

(Continued)

FOREIGN PATENT DOCUMENTS

EP 0752632 A2 1/1997
WO 2004056157 A1 7/2004

(Continued)

*Primary Examiner* — Tung X Le
(74) *Attorney, Agent, or Firm* — Meenakshy Chakravorty

(57) ABSTRACT

The present invention relates to a control unit (108) for a lighting system (100) comprising at least two individually controllable light sources (102, 104), wherein the control unit (108) is connectable to the at least two individually controllable light sources (102, 104) and configured to control the at least two individually controllable light sources (102, 104), wherein the control unit (108) is further configured to control a first lighting system configuration comprising the at least two individually controllable light sources (102, 104) so as to cause it to emit a first illumination pattern (120) provided jointly by the at least two light sources (102, 104) of the first lighting system configuration, detect and store an initial set of illumination parameters being indicative of the first illumination pattern (120), determine a subsequent set of illumination parameters being indicative of a second illumination pattern (122) provided by a second lighting system configuration comprising individually controllable light sources (102, 106), the second lighting system configuration being different from the first lighting system configuration, and control, in dependence on the initial set and the subsequent set of illumination parameters, the second lighting system configuration so as to cause it to emit a third illumination pattern (124), the third illumination pattern (124) being an approximation of the first illumination pattern (120). The present invention provides advantages in respect of e.g. automatic "healing" of the lighting system (100), for example in the case where a light source (102, 104) of the lighting system (100) fails or is only capable of providing less than the normal rated light output.

14 Claims, 3 Drawing Sheets

(56) References Cited

U.S. PATENT DOCUMENTS

| | | | | |
|---|---|---|---|---|
| 2005/0057188 | A1* | 3/2005 | Wong et al. | 315/291 |
| 2006/0202851 | A1 | 9/2006 | Cash et al. | |
| 2008/0130015 | A1* | 6/2008 | Lu | 356/610 |
| 2008/0185969 | A1 | 8/2008 | Vegter et al. | |
| 2009/0267524 | A1* | 10/2009 | Draaijer et al. | 315/153 |

FOREIGN PATENT DOCUMENTS

| | | | |
|---|---|---|---|
| WO | 2007033667 | A1 | 3/2007 |
| WO | 2008068693 | A1 | 6/2008 |
| WO | 2008142603 | A2 | 11/2008 |
| WO | 2009112996 | A2 | 9/2009 |
| WO | 2009130643 | A1 | 10/2009 |

* cited by examiner

ADAPTABLE LIGHTING SYSTEM

TECHNICAL FIELD

The present invention relates to a control unit for an adaptable lighting system, specifically a lighting system being at least partly adaptable to a change of illumination pattern for portions of the lighting system. The invention also relates to a corresponding method of controlling a lighting system. The invention further relates to a lighting system comprising such a control unit.

BACKGROUND OF THE INVENTION

At present, color adjustable light sources, for example light emitting diodes, combining red, green and blue light to achieve for example white light, are increasingly being used in for example household and commercially available lighting systems. The control of such lighting systems for creating application-specific lighting scenes has conventionally been performed by technicians having certain skills and experience, since controlling of for example brightness, color and saturation parameters is relatively complicated and conventionally requires certain knowledge and skills.

As the use of color adjustable light sources has increased, also the demand for intuitive control of such lighting systems for creating application-specific lighting scenes has increased among users other than experts. An example of such an intuitive control of a lighting system is disclosed in WO 2009/130643 A1. The lighting system is provided with a light system controller for controlling the lighting scene that may be created with the lighting system, the light system controller comprising a user interface for receiving at least one user-defined lighting scene descriptor as a user input and processing means adapted for modifying the properties of the actual lighting scene created with the lighting system in accordance with a received user-defined lighting scene descriptor for outputting appropriate control signals for light sources of the lighting system for creating the lighting scene in accordance with the input received from the processing means. The disclosed light system controller allows a user to easily create and modify lighting scenes, which may be created with the lighting system.

Although WO 2009/130643 A1 provides an improved and more intuitive user interface for controlling the lighting scene provided by the lighting system, it may be desirable to further enhance the lighting system, for example in respect of the failure of light sources and the introduction of new light sources into the lighting system for further enhancing the simplicity for a user in controlling the lighting system.

SUMMARY OF THE INVENTION

According to an aspect of the invention, the above is at least partly achieved by a control unit for a lighting system comprising at least two individually controllable light sources, wherein the control unit is connectable to the at least two individually controllable light sources and configured to control the at least two individually controllable light sources, wherein the control unit is further configured to control a first lighting system configuration comprising the at least two individually controllable light sources so as to cause it to emit a first illumination pattern provided jointly by the at least two light sources of the first lighting system configuration, detect and store an initial set of illumination parameters being indicative of the first illumination pattern, determine a subsequent set of illumination parameters being indicative of a second illumination pattern provided by a second lighting system configuration comprising individually controllable light sources, the second lighting system configuration being different from the first lighting system configuration, and control, in dependence on the initial set and the subsequent set of illumination parameters, the second lighting system configuration so as to cause it to emit a third illumination pattern, the third illumination pattern being an approximation of the first illumination pattern.

According to the invention, an initial set of illumination parameters are first decided on and, at a later stage (or at regular intervals), compared to a subsequent set of illumination parameters for determining if any difference exists. If a difference does exist, which is possibly larger than a predetermined threshold, it is understood that at least something has changed within the lighting system, and the lighting system may be automatically adapted such that a perceived illumination pattern is kept as close as possible to the initially (i.e. first) provided illumination pattern. The present invention provides advantages in respect of e.g. automatic "healing" of the lighting system, for example in a case where a light source of the lighting system fails or is only capable of providing less than the normal rated light output. Furthermore, the lighting system according to the invention is not limited to only a first and a second light source, but may include further light sources. Also, the light sources may e.g. be comprised in any type of luminaire.

The transition from a first lighting system configuration to a second lighting system configuration may also be defined as resulting from at least one of the replacement of a light source of the lighting system with a different light source, the addition of a light source to the lighting system, the repositioning of a light source of the lighting system, and the removal of a light source from the lighting system. Also, and preferably, each of the individually controllable light sources at least partly provides different spatial lighting distributions.

The illumination parameters, being indicative of the different illumination patterns, are preferably indicative of at least one of the direction of light emitted by the light sources of at least one of the first and the second lighting system configuration, the color of light emitted by the light sources of at least one of the first and the second lighting system configuration and the intensity of light emitted by the light sources of at least one of the first and the second lighting system configuration. Accordingly, controlling the light sources may not only include information as to how much light and what color of light should be provided by each of the light sources, but also include the control of means for controlling the direction in which light is emitted. The means for the direction of light may for example include adjustable lenses, stepper motors for redirecting the light sources, etc.

Advantageously, the control unit is further configured to determine an individual illumination pattern provided by light sources of at least one of the first and the second lighting system configuration. The determination of the individual illumination pattern for each of the light sources of the lighting system may be used for determining a "light map" for the area being illuminated by the lighting system, including the light contribution provided by each of the light sources. The determination of the individual illumination patterns for each of the light sources, as well as for determining the different illumination patterns for the lighting system, may be done using sensors comprised with and/or connected to the control unit. The sensors may depend on the light sources used and the type of light being emitted by the light sources. It should further be noted that the illumination patterns may comprise a sequence of consecutive illumination patterns.

The control unit and/or the sensors may be embedded in a hand-held and possibly wireless remote control. The control unit may also be a separate unit. The remote control may be used for setting the first illumination pattern as well as for determining the further illumination patterns during the determination phase as well as for controlling the light sources. However, the functionality of the control unit and the sensors may also be distributed, and the control of the light sources may be done using a control unit having a wired connection to the light sources. Also, the sensors used in the determination of the current/individual illumination pattern may e.g. be provided adjacent to the respective light sources, wall mounted, etc. Preferably, the control unit as discussed above is comprised in the lighting system further comprising the at least two individually controllable light sources.

In an embodiment of the invention, each of the light sources of the lighting system is configured to transmit identification information corresponding to its individual illumination pattern. By means of providing further information with the emitted light, the determination of the different illumination patterns may be simplified, and thus the selection of the sensors used in the determination of the illumination patterns may be performed accordingly. The identification information may be provided with the individual illumination patterns provided by each of the light sources, e.g. in the form of coded light. The identification information may also be provided separately, for example as an RF signal transmitted by the light source, ultra sound and/or IR light. Additionally, an RF signal or ultra sound may be used for determining the specific location of each of the light sources. In such a case, the sensors and/or control unit may be adjusted for such measurements reflecting the relative position of the light sources.

According to another aspect of the invention, there is provided a method of controlling a lighting system, the method comprising the steps of controlling a first lighting system configuration, comprising at least two individually controllable light sources, so as to cause it to emit a first illumination pattern provided jointly by the at least two light sources of the first lighting system configuration, detecting and storing an initial set of illumination parameters being indicative of the first illumination pattern, determining a subsequent set of illumination parameters being indicative of a second illumination pattern provided by a second lighting system configuration comprising individually controllable light sources, the second lighting system configuration being different from the first lighting system configuration, and controlling, in dependence on the initial set and the subsequent set of illumination parameters, the second lighting system configuration so as to cause it to emit a third illumination pattern, the third illumination pattern being an approximation of the first illumination pattern. This aspect of the invention provides similar advantages as discussed above in respect of the previous aspects of the invention.

Accordingly, and as discussed above, the lighting system may comprise more than two light sources, e.g. a third light source. Advantages of the inventive method include the possibility to handle also the introduction of further light sources, such as the third light source. The introduction of the third light source into the lighting system, enables the lighting system to automatically adapt the drive signals for each of the light sources, e.g. the first, the second and the third light source, such that essentially the predetermined illumination pattern is achieved, for example by dimming and redirecting the first and the second light source. Such adjustments to the first and the second light source may provide a prolonged lifetime of the first and the second light sources as they possibly do not have to be operated at a level as high as when only the first and the second light sources are present. The self healing feature of the lighting system is further improved, and a redundancy to the system may be provided as possibly essentially the same illumination pattern may be achieved with only two of the three light sources.

The feature of allowing the introduction of a further light source into the lighting system may also be used in conjunction with "neighborhood profiling", i.e. one light source is moved from a first lighting system to a second lighting system. As a result of being introduced into the second lighting system, the light source may e.g. automatically adapt and match to the lighting settings (e.g. illumination pattern) of the second lighting system for further enhancing the functionality and redundancy of the second lighting system. The identification and joining of the second lighting system (from the perspective of the light source) may e.g. be provided by listening to network traffic generated by the second lighting system, for example including listening to RF, IR, ultrasound or other signals generated by the second lighting system.

Further features and advantages of the present invention will become apparent when studying the appended claims and the following description. The skilled addressee realizes that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
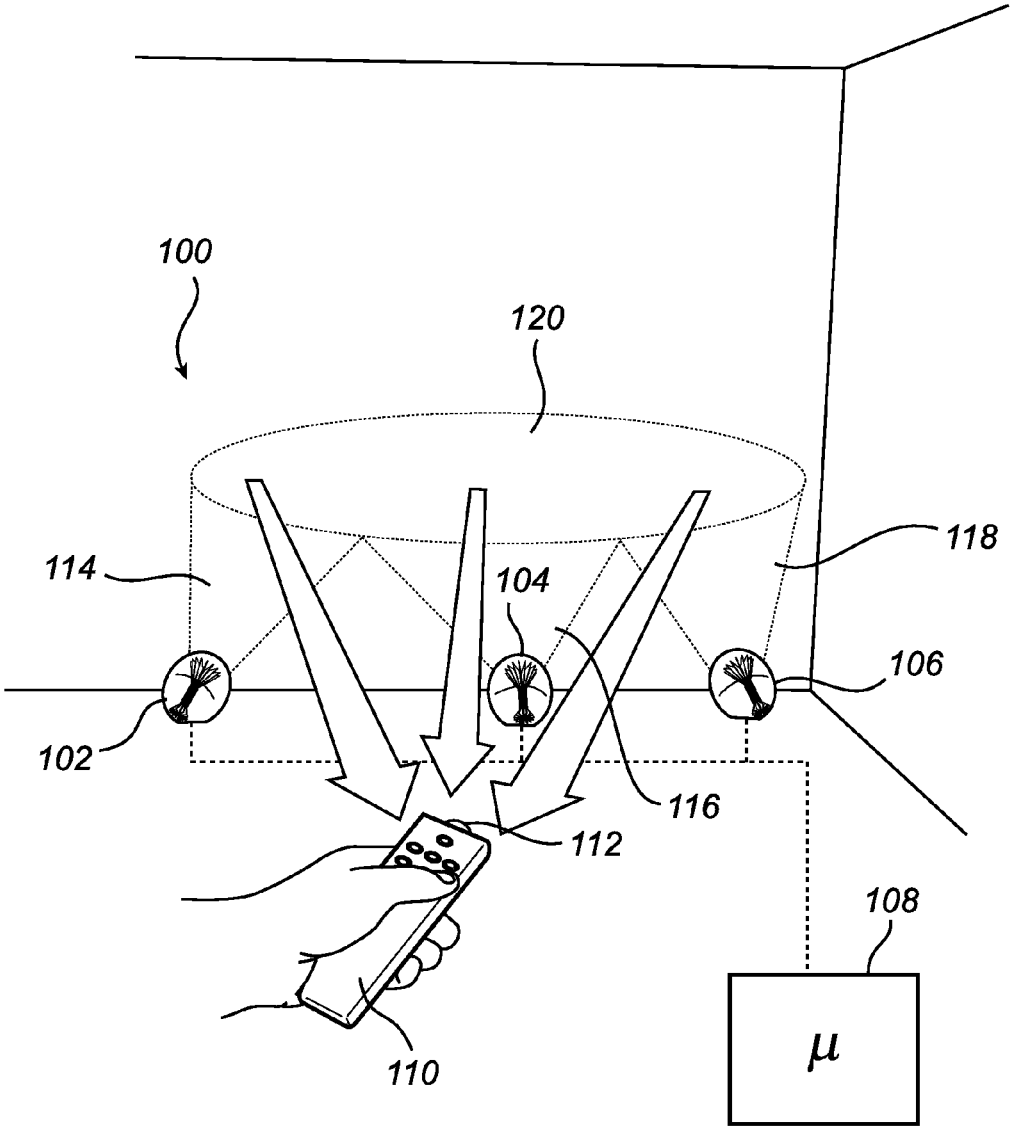
FIG. 1 illustrates a lighting system according to a currently preferred embodiment of the invention.

The present invention will be described more fully hereinafter with reference to the accompanying drawings, in which currently preferred embodiments of the invention are shown. This invention may, however, be embodied in many different forms and should not be construed as being limited to the embodiments set forth herein; rather, these embodiments are provided for thoroughness and completeness, and fully convey the scope of the invention to the skilled addressee. Like reference characters refer to like elements throughout.

Referring now to the drawings and to FIG. 1 in particular, there is depicted a lighting system 100 according to a currently preferred embodiment of the invention. The lighting system 100 comprises three light sources 102, 104, 106, each being individually controllable, for example as regards e.g. intensity, color and direction of emitted light. The lighting system 100 further comprises a control unit 108 connected to the light sources 102, 104, 106, for example by means of a wired and/or wireless connection for providing drive signals to the light sources 102, 104, 106.

The control unit 108 may include a microprocessor, microcontroller, programmable digital signal processor or another programmable device. The control unit 108 may also, or instead, include an application specific integrated circuit, a programmable gate array or programmable array logic, a programmable logic device, or a digital signal processor. When the control unit 108 includes a programmable device such as the microprocessor, microcontroller or programmable digital signal processor mentioned above, the processor may further include a computer executable code that controls the operation of the programmable device.

For controlling the lighting system 100, the lighting system may comprise a user interface, such as a remote control 110. The remote control 110 may also be connected to the control unit 108, advantageously by means of a wireless connection, even though for example a wall mounted user interface is possible having wired connections to the control unit 108. In embodiments of the invention, the remote control 110 and the control unit 108 may be combined, e.g. allowing the remote control 110 to be configured so as to be connected to the light sources 102, 104, 106 and provide the drive signals to the light sources 102, 104, 106.

The remote control 110 may be equipped with a sensor 112 for measuring an illumination pattern provided by the light sources 102, 104, 106. More specifically, in the illustrated exemplary embodiment, the light sources 102, 104, 106 are each configured to emit an illumination pattern 114, 116, 118, respectively, which together form a joint illumination pattern 120 as perceived by a user. Accordingly, the sensor 112 may be configured to measure the joint illumination pattern 120 and/or the individual illumination patterns 114, 116, 118 provided by the light sources 102, 104, 106. For simplifying e.g. the extraction of the individual illumination patterns 114, 116, 118 from the joint illumination pattern 120, the light emitted by the respective light sources 102, 104, 106 may be coded, for example by modulating the light emitted by each of the respective light sources 102, 104, 106. Other alternatives are also possible and within the scope of the invention, including for example the transmission of IR, UV, ultrasound and RF signals representing the individual illumination patterns provided by the light sources 102, 104, 106. In such alternative embodiments, the light sources 102, 104, 106 may be equipped with means for transmitting e.g. IR, UV, ultrasound and RF signals representing the individual illumination patterns. Additionally, the sensor 112 may alternatively be arranged with the control unit 108, for example as a wall mounted sensor for measuring the light emitted by each of the light sources 102, 104, 106.

Figure 2A:
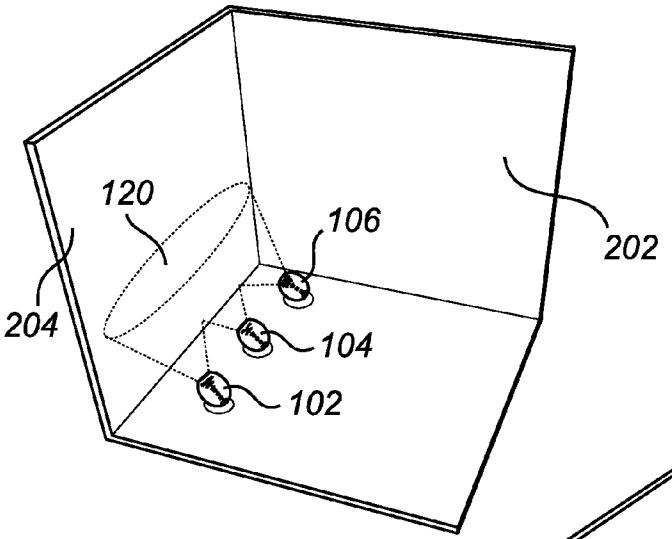
FIGS. 2*a*-2*c* show the adaptable functionality of the lighting system of FIG. 1.

During operation of the lighting system 100, with reference to FIGS. 2*a-c* and 3 in parallel, the illumination system 100 comprising the three light sources 102, 104 and 106 is provided in a space, such as a room 202. As is illustrated in FIG. 2*a*, all three light sources 102, 104 and 106 are controlled, S1, by the remote control 110 to provide a first illumination pattern 120 e.g. on the wall 204 of the room 202. The first pattern 120 is illustrated in FIG. 2*a* as an illuminated area (i.e. direction of light), but may of course also relate to other features of light, including for example color and/or intensity of the light emitted by the light sources 102, 104, 106. The first illumination pattern 120 may e.g. be selected from a selection of available lighting settings using the remote control 110, or defined using e.g. control means, such as buttons, on the remote control 110. Once the user is satisfied with the first illumination pattern 120, he/she detects and stores, S2, illumination parameters being indicative of the first illumination pattern, preferably using the remote control 110.

Figure 2B:
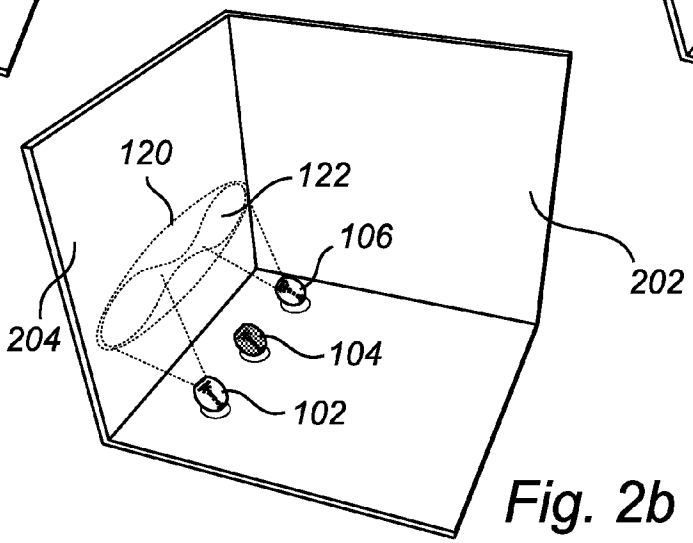

However, as is illustrated in FIG. 2*b*, the light source 104 fails, e.g. stops to emit light due to an empty battery, breakage, or removal from its original location etc, as a result of which a second illumination pattern 122 is provided, which is perceived as different when compared to the first illumination pattern 120 as was present when all three light sources 102, 104, 106 were functioning. This is noted, e.g. by the user operating the lighting system 100 or automatically by the lighting system 100 itself. If the user operating the system notes the failed light source 104, the user may point the remote control 108 towards the area being illuminated by the light sources 102, 106 for example by means of the sensor 112 to measure the "new" illumination pattern, i.e. in this case the second illumination pattern 122. The remote control 110 is once again used for detecting, S3, subsequent illumination parameters, this time being indicative of the second illumination pattern 122. The remote control 110 communicates the subsequent illumination parameters (possibly comprising information about the individual light emitted by each of the light sources 102, 106) to the control unit 108, and the control unit 108 determines a new set of control signals for the remaining light sources of the lighting system (i.e. in this case comprising the active light sources 102, 106). As the light source 104 has failed, the drive signals for this light source may be set to "do not use light source 104". Alternatively, the light source 104 may be replaced by a light source with a different spatial lighting distribution, giving rise to yet another illumination pattern (not shown), and requiring further adjustment from the control unit.

Figure 2C:
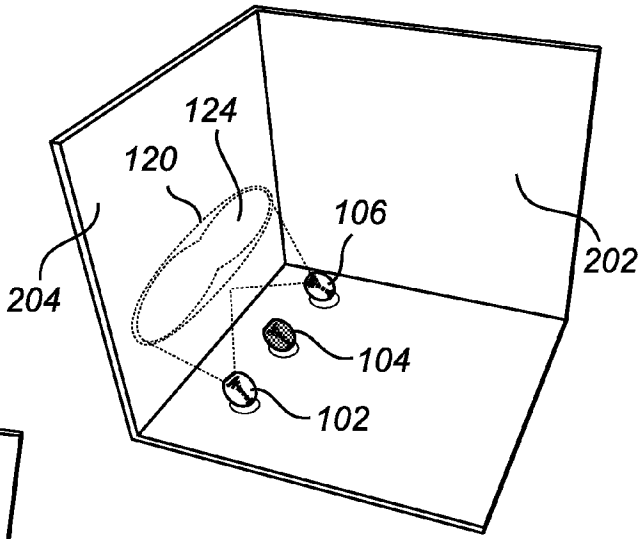
Figure 3:
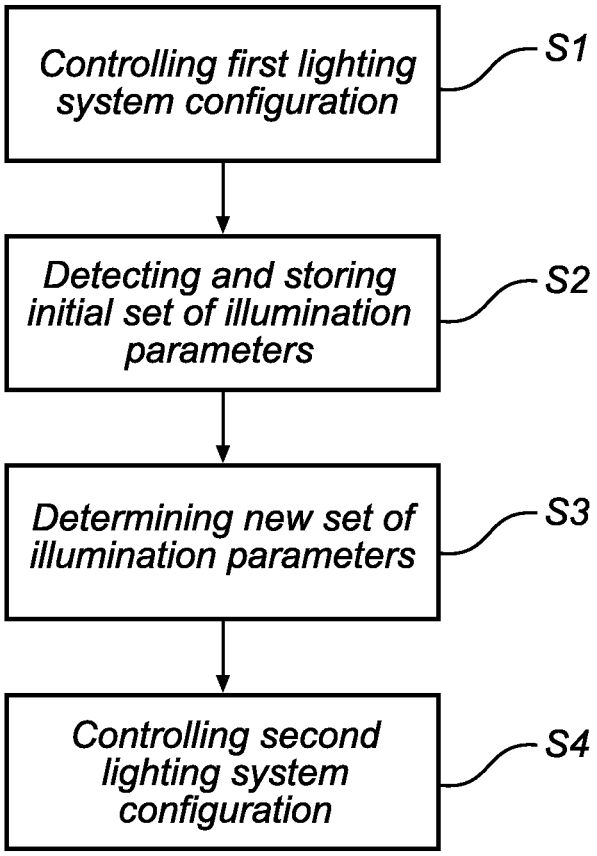
FIG. 3 illustrates a flow chart for operating the inventive method of controlling the lighting system.

In FIG. 2*c*, the result of using the adjusted control signals for controlling, S4, the light sources 102 and 106 is illustrated. The control signals for the light sources 102 and 106 have been adapted such that the difference between a further third illumination pattern 124, resulting from only light from the two functioning light sources 102 and 106, is minimized in relation to the first illumination pattern 120. The process of minimizing the difference between the third illumination pattern 124 and the first illumination pattern 120 may be achieved iteratively, e.g. by measuring consecutively using the sensor 112. Other methods of achieving a minimized difference are of course possible, including mathematical calculations, and are within the scope of the invention. For reference, FIGS. 2*b* and 2*c* show the first illumination pattern 120.

Additionally, the operation of the method may be extended to include the introduction of further light sources into the lighting system 100. An example of such an embodiment includes moving a light source from a first lighting system to a second lighting system. In such a case, the light source being moved to the second light source may be monitoring "network traffic" between already present light sources of the second lighting system, and, based on the network traffic, may determine the joint illumination pattern provided by the second lighting system. This concept may be referred to as "neighborhood profiling". The network traffic may be based on e.g. RF, IR, ultrasound or other signals generated by the second lighting system.

Even though the invention has been described with reference to specific exemplifying embodiments thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims. For example, even though the above description has been made with respect to a single lighting pattern, combined illumination patterns are possible and within the scope of the invention, for example illustrated as a sequence of illumination patterns. A combined illumination pattern may also be exemplified as an illumination scene, e.g. illustrated as a "summer day illumination sequence", a "rainbow illumination sequence". As discussed above, according to the invention, the introduction and/or removal of a light source will result in attempts to keep the scene essentially intact by adjusting drive signals for the functioning light sources.

Furthermore, in the claims, the word "comprising" does not exclude other elements or steps, and the indefinite article "a" or "an" does not exclude a plurality.

The invention claimed is:

1. A control unit for a lighting system comprising at least two individually controllable light sources, wherein the control unit is connectable to the at least two individually controllable light sources and configured to control the at least two individually controllable light sources, wherein the control unit is further configured to:

control a first lighting system configuration comprising the at least two individually controllable light sources to emit a first illumination pattern provided jointly by the at least two light sources of the first lighting system configuration;

detect and store an initial set of illumination parameters being indicative of the first illumination pattern;

determine a subsequent set of illumination parameters being indicative of a second illumination pattern provided by a second lighting system configuration comprising individually controllable light sources, the second lighting system configuration being different from the first lighting system configuration; and control, in dependence on the initial set and the subsequent set of illumination parameters, the second lighting system configuration to emit a third illumination pattern, the third illumination pattern being an approximation of the first illumination pattern.

2. The control unit according to claim 1, further configured to determine an individual illumination pattern provided by light sources of at least one of the first and the second lighting system configuration.

3. The control unit according to claim 1, comprising sensors for measuring the illumination patterns.

4. The control unit according to claim 1, further configured to determine a relative position of light sources of at least one of the first and the second lighting system configuration, using location information transmitted by light sources, such location information being indicative of a respective location of the light sources.

5. A lighting system comprising:

at least two individually controllable light sources; and a control unit connectable to the at least two individually controllable light sources and configured to control the at least two individually controllable light sources, wherein a first lighting system configuration comprising the at least two individually controllable light sources is controlled to emit a first illumination pattern provided jointly by the at least two light sources of the first lighting system configuration, an initial set of illumination parameters being indicative of the first illumination pattern is detected and stored by the control unit, a subsequent set of illumination parameters being indicative of a second illumination pattern provided by a second lighting system configuration comprising individually controllable light sources is determined, the second lighting system configuration being different from the first lighting system configuration, and wherein the second lighting system configuration is controlled, in dependence on the initial set and the subsequent set of illumination parameters, to emit a third illumination pattern, the third illumination pattern being an approximation of the first illumination pattern.

6. The lighting system according to claim 5, wherein the light sources at least partly provide different spatial lighting distributions.

7. The lighting system according to claim 5, wherein the light sources are configured to transmit identification information indicative of a respective individual illumination pattern.

8. The lighting system according to claim 7, wherein the identification information is embedded with the individual illumination pattern.

9. The lighting system according to claim 5, wherein at least one of the initial and the subsequent set of illumination parameters is indicative of at least one of the direction of light emitted by the light sources, the color of light emitted by the light sources and the intensity of light emitted by the light sources.

10. The lighting system according to claim 5, wherein at least one of the first and second illumination pattern comprises a sequence of consecutive illumination patterns.

11. A method of controlling a lighting system, the method comprising the steps of:

controlling a first lighting system configuration, comprising at least two individually controllable light sources, to emit a first illumination pattern provided jointly by the at least two light sources of the first lighting system configuration;

detecting and storing an initial set of illumination parameters being indicative of the first illumination pattern;

determining a subsequent set of illumination parameters being indicative of a second illumination pattern provided by a second lighting system configuration comprising individually controllable light sources, the second lighting system configuration being different from the first lighting system configuration; and controlling, in dependence on the initial set and the subsequent set of illumination parameters, the second lighting system configuration to emit a third illumination pattern, the third illumination pattern being an approximation of the first illumination pattern.

12. The method according to claim 11, wherein the light sources at least partly provide different spatial lighting distributions.

13. The method according to claim 11, wherein at least one of the steps of detecting and storing an initial set of illumination parameters and determining a subsequent set of illumination parameters comprises the step of determining at least one of the direction of light emitted by the light sources, the color of light emitted by the light sources and the intensity of light emitted by the light sources.

14. The method according to claim 11, wherein a transition from a first lighting system configuration to a second lighting system configuration results from at least one of the replacement of a light source of the lighting system, the addition of a light source to the lighting system, the repositioning of a light source of the lighting system, and the removal of a light source from the lighting system.

* * * * *